United States Patent [19]

Burchers

[11] 4,093,218

[45] June 6, 1978

[54] MODULAR BALL REBOUND APPARATUS

[76] Inventor: Samuel A. Burchers, 1910 Jamaica Way, Punta Gorda, Fla. 33950

[21] Appl. No.: 745,417

[22] Filed: Nov. 26, 1976

[51] Int. Cl.[2] ..... A63B 61/00

[52] U.S. Cl. ..... 273/29 A

[58] Field of Search ..... 273/30, 26 A, 181 R, 273/181 K, 102 R, 102 S, 102 B, 127 R, 127 B, 102.4, 103, 176 B, 176 D, 29 A, 102.1 R, 105 R, 105 A, DIG. 7, DIG. 8; 248/441 R, 454, 133, 444, 457, 460, 464, 465, 166

[56] References Cited

U.S. PATENT DOCUMENTS

| | | | |
|---|---|---|---|
| 1,289,377 | 12/1918 | Brown | 248/464 |
| 1,582,599 | 4/1926 | Hanson | 248/465 |
| 2,582,070 | 1/1952 | Safer | 248/464 |
| 2,875,117 | 2/1959 | Potchen et al. | 273/DIG. 7 |
| 3,100,115 | 8/1963 | Breneman | 273/102.4 |
| 3,244,419 | 4/1966 | Lerman | 273/DIG. 8 |
| 3,616,185 | 10/1971 | Goldberg | 273/DIG. 8 |
| 3,635,482 | 1/1972 | Holman | 273/DIG. 8 |
| 3,810,616 | 5/1974 | Murphy | 273/102 S |
| 3,824,199 | 8/1974 | Nadeau et al. | 273/DIG. 8 |
| 3,880,423 | 4/1975 | Kreag | 273/103 X |

FOREIGN PATENT DOCUMENTS

| | | | |
|---|---|---|---|
| 2,308,082 | 8/1974 | Germany | 273/29 A |
| 24,288 of | 1912 | United Kingdom | 273/30 |
| 471,041 | 8/1937 | United Kingdom | 248/460 |
| 804,104 | 11/1958 | United Kingdom | 248/460 |

*Primary Examiner*—Richard C. Pinkham
*Assistant Examiner*—T. Brown
*Attorney, Agent, or Firm*—Alfred E. Wilson

[57] ABSTRACT

A modular ball rebound apparatus to assist a beginner or a serious tennis player to improve his or her game, the apparatus being comprised of a plurality of panels for removable mounting on an easel which is adjustable to vary the angle of inclination of the panels to vary the speed, bounce and elevation of the return of a ball after striking one of the panels, the surfaces of which are coated with an energy absorbing material to control the speed of the return.

1 Claim, 3 Drawing Figures

MODULAR BALL REBOUND APPARATUS

FIELD OF THE PRESENT INVENTION

The present invention pertains to an easel supported modular ball rebound apparatus and more particularly to an apparatus of this nature which includes a plurality of rebound panels which may be used singly or in any desired number or arrangement, and which includes means to control the return of a ball after striking one of the modular panels.

BACKGROUND OF THE PRESENT INVENTION

A substantial number of tennis training devices have been devised, a great portion of which utilize nets or woven webbings of a variety of types to return a tennis ball hit thereagainst.

The device of the present invention comprises a portable modular ball rebound apparatus comprised of an easel supporting a plurality of panels, three for example, which may be used singly, in a pair or all three. The easel is adjustable to control the angle of inclination of the panels each of which is constructed of a solid backing member which may be of wood, a light weight metal or other suitable material with an energy absorbing surface material to control the speed of the return of the tennis ball from said surface.

Therefore, one of the principal objects of the present invention is to provide a portable modular ball rebound apparatus which is light enough in weight for an unassisted individual to assemble the apparatus for play, or disassemble it for storage in a garage or other storage area.

A further object of this invention is to provide ball rebound panels having planar surfaces which can be easily adjusted to a wide variety of angles of inclination from the vertical, enabling a player to practice a variety of shots.

Another object of the invention is to provide a plurality of panels, each of which is provided with an energy absorbing front surface material to slow the speed of a rebound to a desirable rate.

Yet another object of the present invention is to provide rebound panel means which can be increased or decreased in size, as determined by the number of panels used, to suit the need or experience of the player or the space available, the individual modules being sufficiently light in weight to be carried and maneuvered by a single average sized person.

Various other objects, features and advantages of the present invention will be obvious from the following description of a preferred form of the invention as illustrated in the drawings.

DETAILED DESCRIPTION OF A PREFERRED EMBODIMENT

Figure 1:
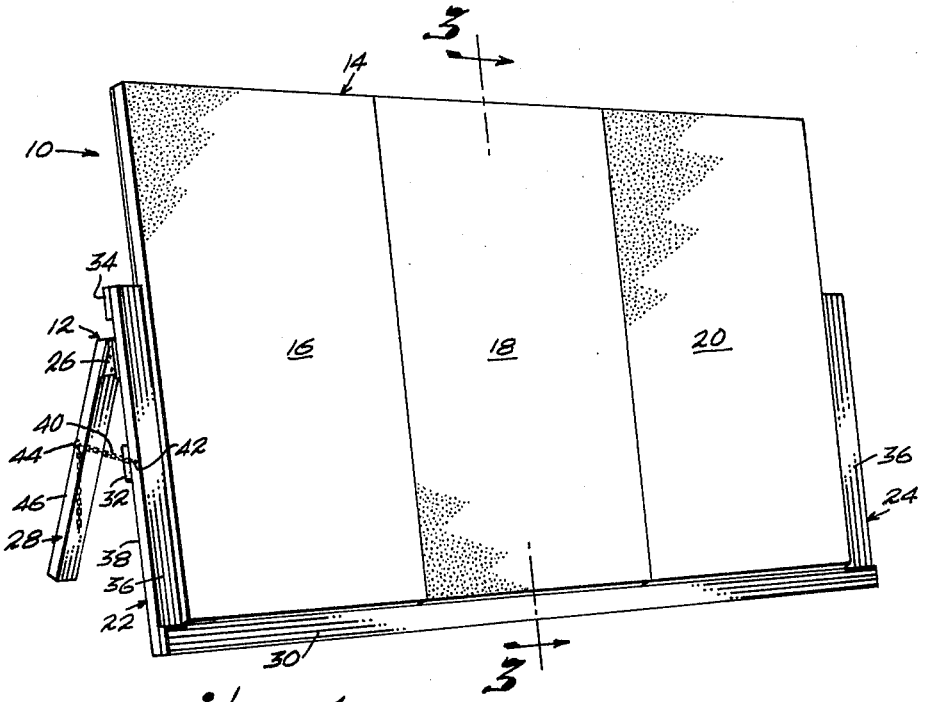
FIG. 1 is a front perspective view of the modular ball rebound apparatus of the present invention.

With reference to the drawings in which like reference characters designate like or corresponding parts throughout the several views and with particular reference to FIG. 1 the modular ball rebound apparatus, indicated generally at 10, is comprised of a support easel 12 for a plurality of panels 14, three illustrated at 16, 18 and 20.

Easel 12 is formed of a pair of side front support legs 22 and 24, each of which is hinged at the top at 26 to a side rear leg 28. Three transverse parallel rails, bottom rail 30, intermediate rail 32 and a top rail 34 are fixed between the front legs 22 and 24 to define a unitary easel structure. Bottom rail 30 is fixed across the front faces 36 of the respective front legs 22 and 24 and the intermediate and top rails 32 and 34 are fixed across the back faces 38 thereof. If desired, the three rails 30, 32 and 34 may be attached to the front legs, 22 and 24 by bolts and wing nuts for disassembling purposes for storage and transportation thereof.

Figure 2:
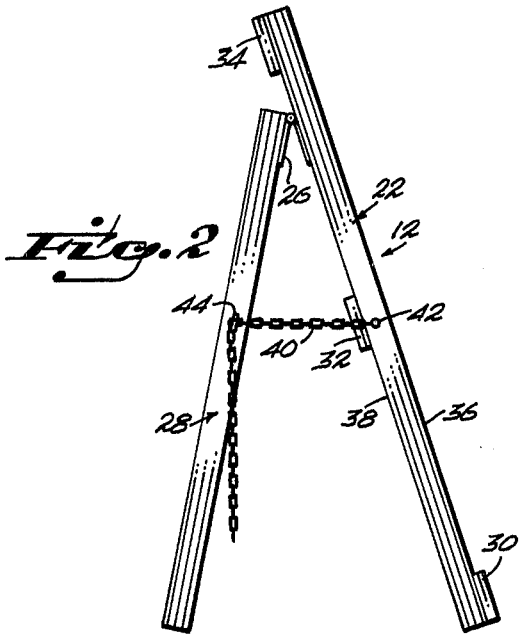
FIG. 2 is an end elevational view of the panel support easel of the present invention.

As best seen in FIGS. 1 and 2, the angular relationship between each pair of front and back legs such as 22 and 28 may be controlled or changed by means of a pair of link chains 40, each being fixed at one end as at 42 to a front leg 22 or 24 and engagable through any selected link to a hook 44 fixed to one of the pair of back legs.

Each panel 16, 18 and 20 is comprised of a rigid backing sheet 48 which may be plywood, metal or other suitable material with a thickness of shock absorbing material 50 such as a cellular synthetic material, polyurethane for example, bonded thereto. Preferably a skin 52 of a tough weather proof material such as fiberglass is laminated to the front surface of 50.

Figure 3:
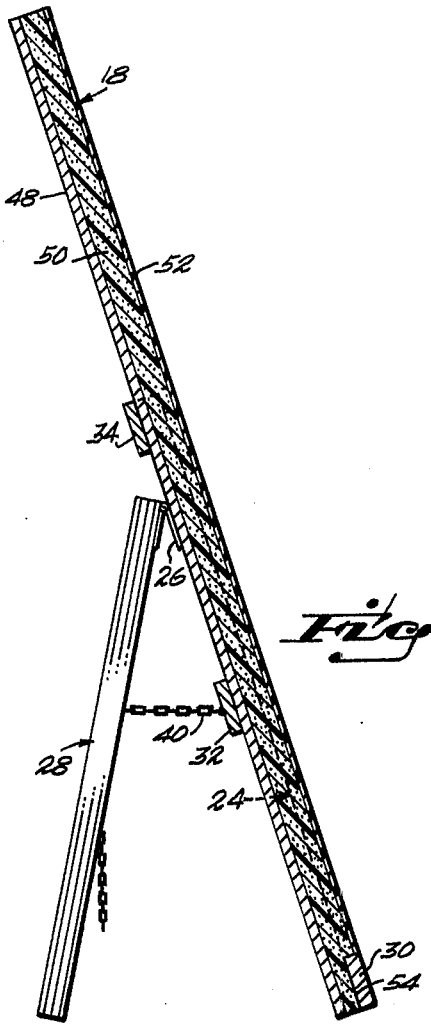
FIG. 3 is a vertical cross sectional view taken along line 3—3 of FIG. 1.

Each panel 16, 18 and 20 is cut out at the bottom as at 54, FIG. 3, to fit behind and on top of bottom rail 30, and each rests against the intermediate and top rails 32 and 34 when in use. The energy absorbing surface of the backboards returns a tennis ball slowly enough to give a player, particularly a beginner, ample time to prepare his strokes. With three backboards, the player has a choice of size, as any desired number of the backboards may be mounted on the easel.

It should be noted that the modular units extend downwardly low enough so that a tennis ball cannot roll under it, and the panels, not being permanently attached to the easel, can be individually or collectively inclined against a wall, fence, tree, etc., and used in the same manner as when the easel support is employed.

While a preferred form of the present invention has been illustrated and described, it will be obvious to anyone skilled in the art that various changes and modifications can be made therein without departing from the true spirit of the invention as defined in the appended claims.

I claim:

1. A portable ball rebound apparatus comprising at least three ball rebound panels each having a planar surface of a shock absorbing material, means to removably support said rebound panels, said means to support said rebound panels comprising an easel including a pair of opposed, spaced apart front legs interconnected by a plurality of transverse parallel rails of a length to removably support said three rebound panels, and a pair of side rear legs hingedly connected at their upper ends to the respective front legs, means to adjust said means to support in a manner so as to selectively position said planar surface at various selective angles of inclination to the vertical, each of said rebound panels comprising a rigid backing sheet with a cellular synthetic material bonded thereto comprising shock absorbing material, and wherein said plurality of transverse parallel rails comprises a bottom rail fixed between the bottom ends of said front legs, each of said rebound panels being notched across its bottom edge in a manner so as to fit behind and on top of said bottom rail, and intermediate and top rails fixed between said front rails in positions to supportingly engage the back of each of said rebound panels.

* * * * *